US007497744B2

(12) United States Patent
Tsai

(10) Patent No.: US 7,497,744 B2
(45) Date of Patent: Mar. 3, 2009

(54) TERMINAL STRUCTURE OF ELECTRICAL CONNECTOR

(76) Inventor: Chou Hsuan Tsai, 15F, No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 12/009,038

(22) Filed: Jan. 16, 2008

(65) Prior Publication Data

US 2008/0171478 A1 Jul. 17, 2008

Related U.S. Application Data

(63) Continuation-in-part of application No. 11/981,903, filed on Nov. 1, 2007, now abandoned.

(30) Foreign Application Priority Data

Jan. 16, 2007 (TW) ..... 096101554

(51) Int. Cl.
*H01R 13/04* (2006.01)

(52) U.S. Cl. ..... 439/862; 439/331

(58) Field of Classification Search ..... 862/862, 862/331, 668, 595, 73, 83
See application file for complete search history.

(56) References Cited

U.S. PATENT DOCUMENTS 5,338,230 A * 8/1994 Bryce et al. ..... 439/629
6,652,329 B1 * 11/2003 Howell et al. ..... 439/862
6,887,114 B2 * 5/2005 Liao ..... 439/862
6,905,377 B2 * 6/2005 Murr ..... 439/862
6,918,799 B2 * 7/2005 Zhu et al. ..... 439/862
6,976,888 B2 * 12/2005 Shirai et al. ..... 439/862
7,074,048 B2 * 7/2006 Liao et al. ..... 439/66
7,297,010 B2 * 11/2007 Tsai ..... 439/331
2005/0070175 A1 * 3/2005 Hashimoto ..... 439/862
2007/0173137 A1 * 7/2007 Liao ..... 439/862

* cited by examiner

*Primary Examiner*—Michael C Zarroli
(74) *Attorney, Agent, or Firm*—Pro-Techter Int'l Services

(57) ABSTRACT

A terminal structure to be assembled in a terminal slot is integrally formed by pressing a metal plate having first and second surfaces. The terminal structure includes a fixing portion and an elastic arm. The first surface of the fixing portion is fixed in the slot and is wider. The arm is connected to the fixing portion. Over 70% of the first surface of the arm are disposed on the same plane and the first surface of the arm has a curved shape. The first surface of the arm is narrower than the first surface of the fixing portion. An angle smaller than 30 degrees is formed between the first surfaces of the arm and the fixing portion. A top end of the arm exceeds a top end of the fixing portion, and is formed with a movable contact.

20 Claims, 9 Drawing Sheets

TERMINAL STRUCTURE OF ELECTRICAL CONNECTOR

CROSS-REFERENCE TO RELATED APPLICATIONS

This application is a continuation in part of, and claims priority under 35 U.S.C. § 120 from, nonprovisional U.S. patent application Ser. No. 11/981,903 entitled "TERMINAL STRUCTURE OF ELECTRICAL CONNECTOR," filed on Nov. 1, 2007 now abandoned, the subject matter of which is incorporated herein by reference.

BACKGROUND OF THE INVENTION

1. Field of Invention

The invention relates to an electrical connector, and more particularly to a terminal structure of an electrical connector, which may be moved vertically for contact.

2. Related Art

A chip (e.g., a CPU) has a bottom surface formed with several contacts. An electrical connector connected to the chip applies a downward force to fix the chip onto a base so that the contacts of the chip can elastically contact terminals arranged in terminal slots of the base to ensure the electrical connections therebetween.

Referring to FIGS. 1 and 2, an electrical connector to be connected to a chip includes a base 10 and terminals 20. Terminal slots 11 are formed on the base 10. The terminals 20 are respectively in the terminal slots 11. Each terminal 20 has a vertically movable elastic arm 21, a fixing portion 22 and a connection sheet 23. The fixing portion 22 tightly presses against the terminal slot 11, and the bottom end thereof is inversely bent upwards to form a second plate 24 extending upwards. The elastic arm 21 is connected to the second plate 24 of the fixing portion 22. The first surface of the elastic arm 21 is bent upwards to one edge 12 of the terminal slot 11 and then curved to extend to and exceed the other edge 13 of the terminal slot 11. A projecting contact 25 is formed near a distal end of the elastic arm 21. The connection sheet 23 extends out of the base 10 and is combined with a solder ball 28.

When the chip is placed on the base 10, each contact of the chip contacts the contact 25 of the terminal 20, and each terminal 20 tightly presses against the contact of the chip by the elasticity of the elastic arm 21 so that the electrical connection effect may be obtained.

The prior art structure has the following drawbacks. First, the elastic arm 21 of the terminal is formed by curving the first surface to achieve the elasticity of up and down movements. So, the terminal slot 11 must have the sufficient length so that the elastic arm 21 can be curved. Second, the size cannot be precisely controlled when the first surface of the elastic arm 21 is being pressed and bent, and the pressing cost is relatively increased.

SUMMARY OF THE INVENTION

It is therefore an object of the invention to provide a terminal structure of an electrical connector, wherein an elastic arm of a terminal is inversely bent upwards from a bottom end of a fixing portion and extends toward one side of a first surface of the fixing portion. Thus, the elastic arm of the terminal has the better contact elasticity, can be easily manufactured, and occupies the less space in a terminal slot when the terminal is being assembled.

To achieve the above-identified object, the invention provides a terminal structure of an electrical connector. The terminal structure is to be assembled in a terminal slot of a plastic base, and is integrally formed by pressing a metal plate having a first surface, which extends in a lengthwise direction and a widthwise direction, and a second surface, which extends in a thickwise direction and the lengthwise direction and is connected to the first surface. The terminal structure includes a fixing portion and an elastic arm. The first surface of the fixing portion is longitudinally fixed in the terminal slot of the plastic base and is wider so that the first surface of the fixing portion is fixed in the terminal slot of the plastic base. The elastic arm is connected to a bottom end of the fixing portion. Over 70% of the first surface of the elastic arm are disposed on the same plane and the first surface of the elastic arm has a curved shape. The first surface of the elastic arm is narrower than the first surface of the fixing portion. An angle smaller than 30 degrees is formed between the first surfaces of the elastic arm and the fixing portion. A top end of the elastic arm exceeds a top end of the fixing portion, and is formed with a contact which may be moved up and down to contact a contact of a chip.

According to the above-mentioned structure, the elastic arm of the terminal has the better contact elasticity, can be easily manufactured, and occupies the less space in the terminal slot when the terminal is being assembled.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

The present invention will be apparent from the following detailed description, which proceeds with reference to the accompanying drawings, wherein the same references relate to the same elements.

Figure 2:
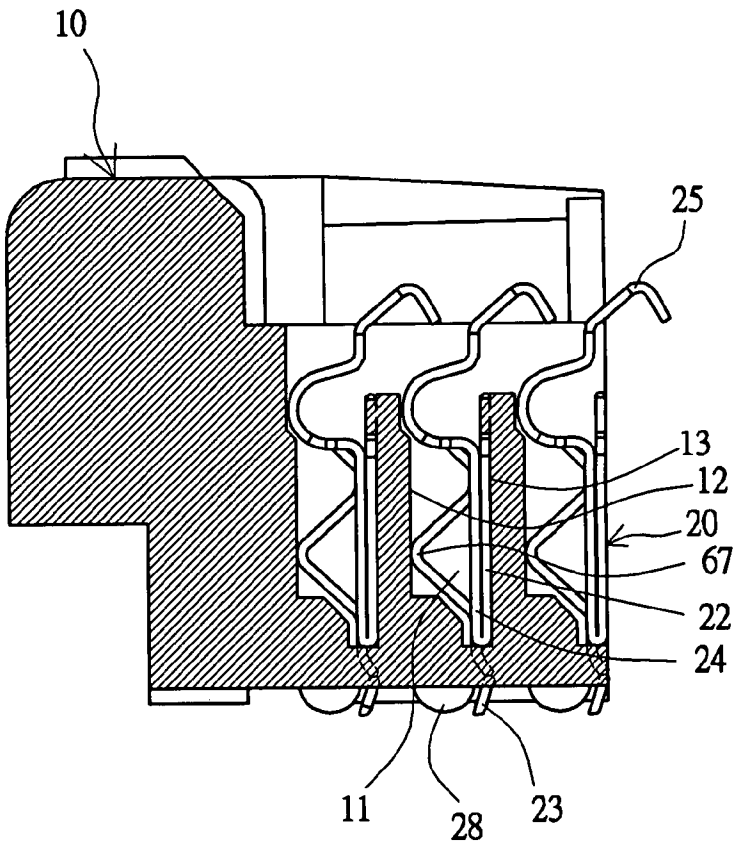
FIG. 2 (Prior Art)
FIG. 2 is an assembled cross-sectional view showing the conventional electrical connector.
Figure 1:
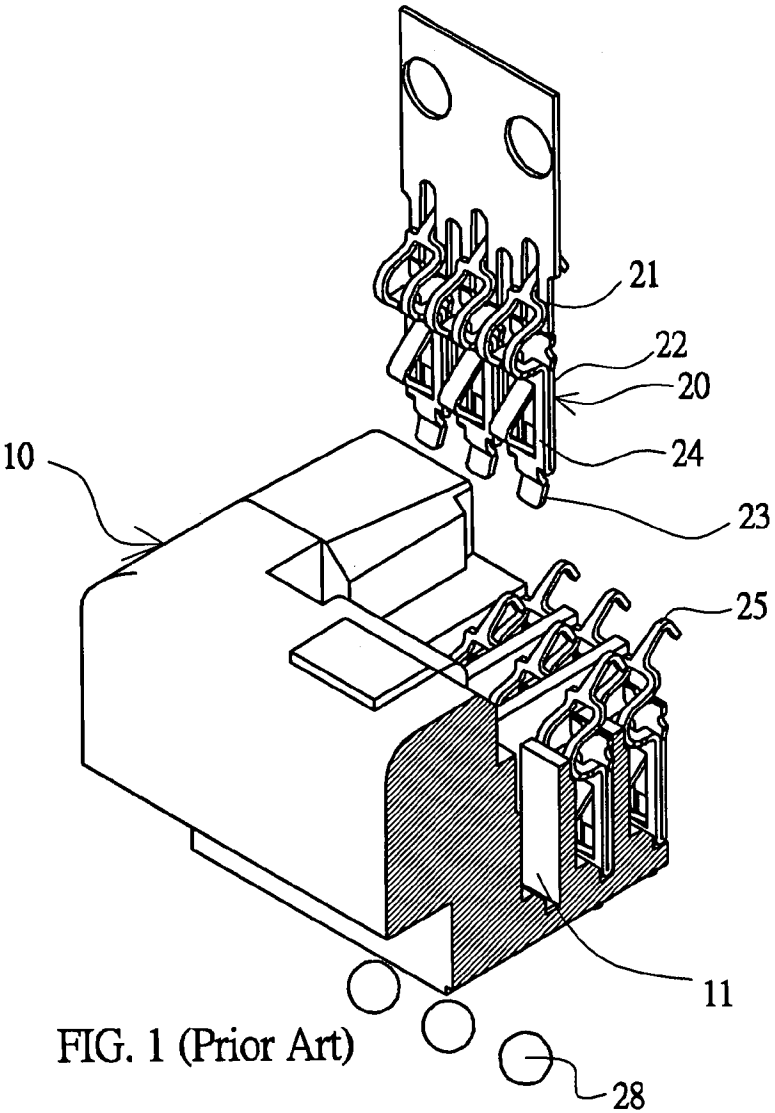
FIG. 1 (Prior Art)
FIG. 1 is a pictorially exploded view showing a conventional electrical connector.
Figure 3:
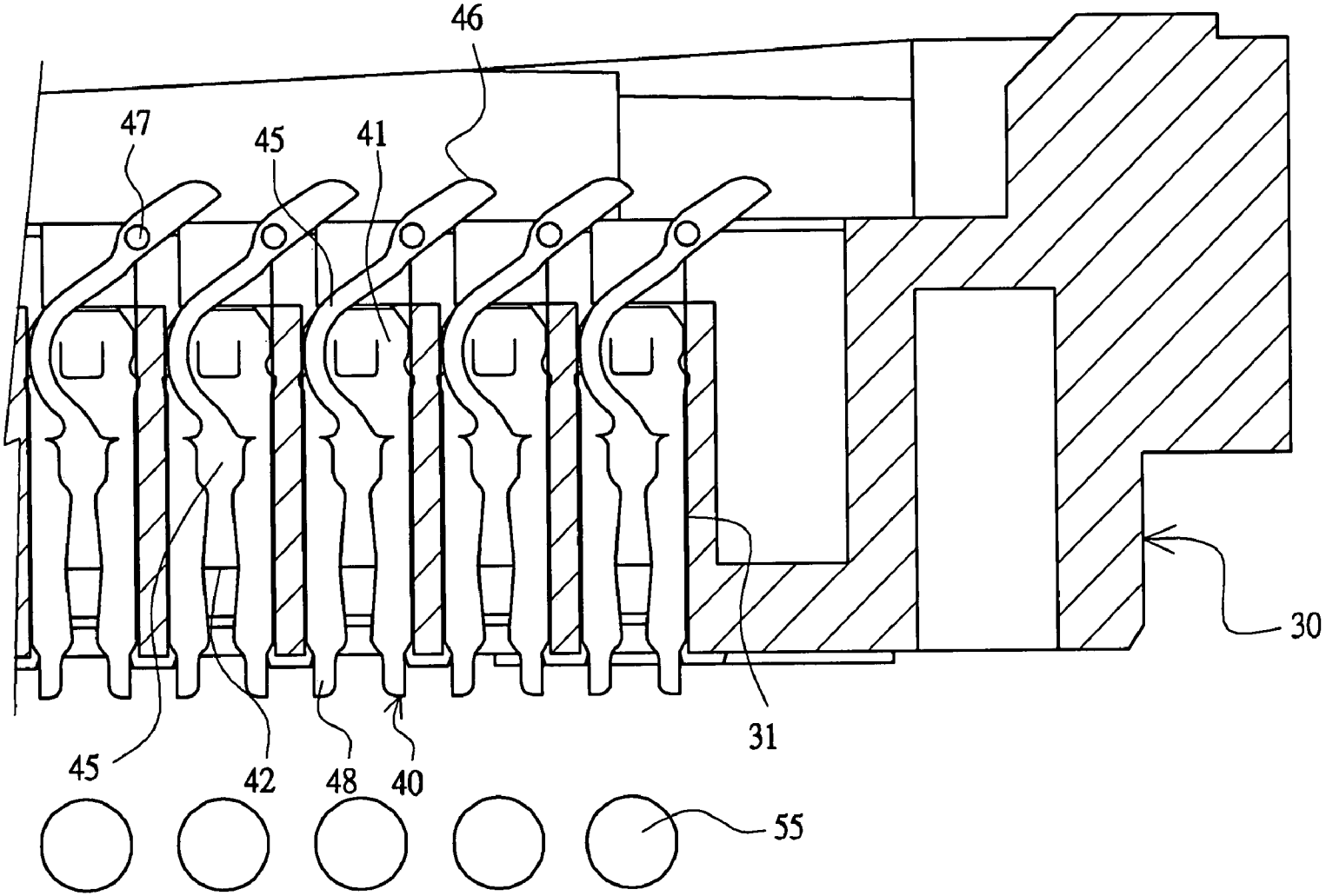
FIG. 3 is an assembled cross-sectional view showing a connector according to a preferred embodiment of the invention.
Figure 4:
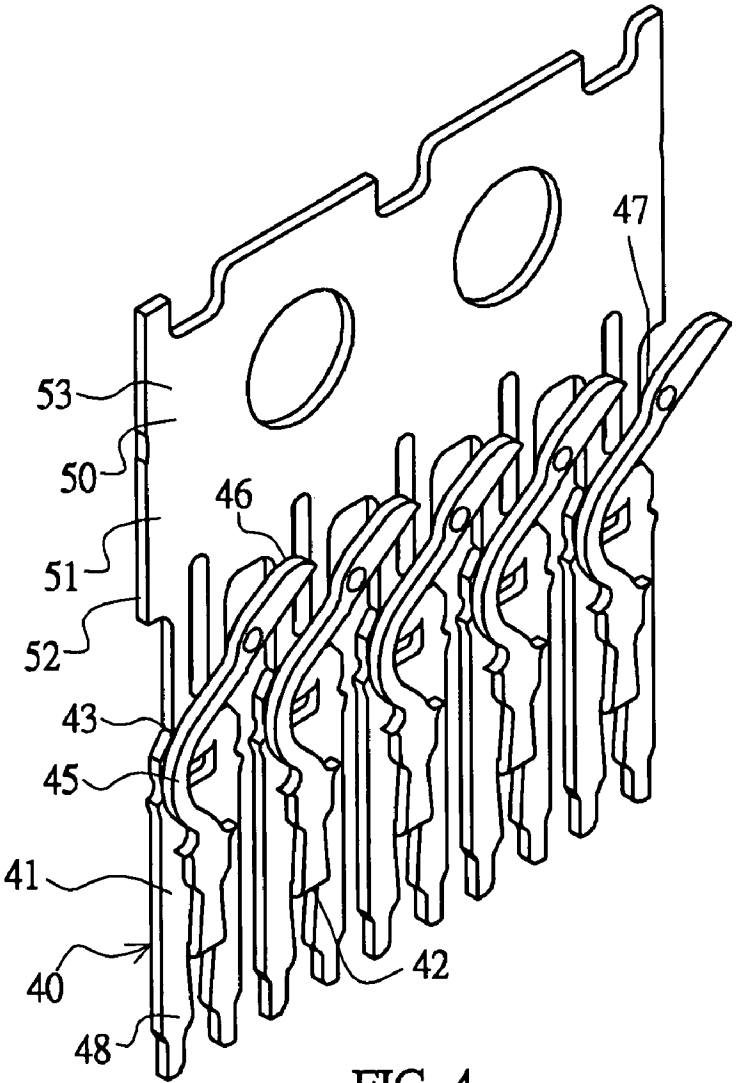
FIG. 4 is a pictorial view showing a terminal structure according to a first embodiment of the invention.

Referring to FIGS. 3 and 4, an electrical connector according to this embodiment includes a plastic base 30 and a plurality of terminals 40.

The plastic base 30 is formed with several rows of terminal slots 31.

Figure 5:
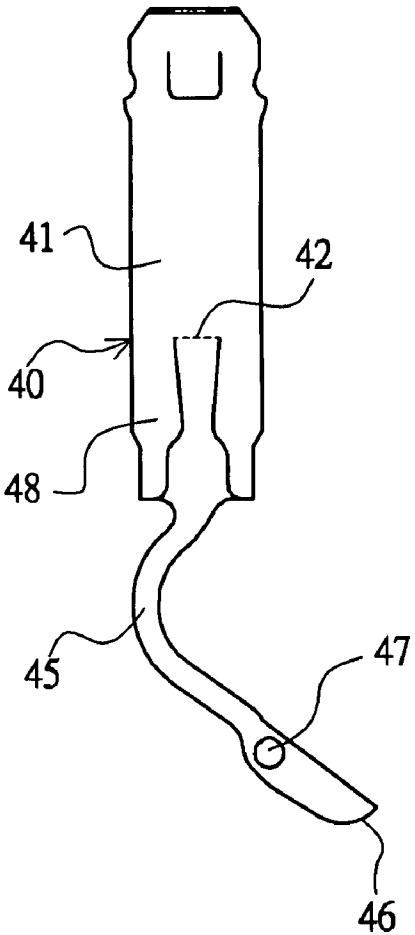
FIG. 5 is a developed plane view showing the terminal structure according to the first embodiment of the invention.

As shown in FIG. 5, the terminals 40 are integrally formed by pressing a metal plate 50 so that the continuous terminals 40 formed are connected to a material tape 53. The metal plate 50 has a first surface 51, which extends in a lengthwise direction and a widthwise direction, and a second surface 52, which extends in a thickwise direction and the lengthwise direction and is connected to the first surface 51. The continuous terminals 40 are assembled, from top to bottom, into the terminal slots 31. The terminal 40 includes a fixing portion 41, an elastic arm 45 and two connection sheets 48. The fixing portion 41 is longitudinally fixed in the terminal slot 31 of the plastic base 30. The first surface of the fixing portion 41 is wider so that the first surface of the fixing portion 41 can be fixed in the terminal slot 31 of the plastic base 30. A top end 43 of the fixing portion 41 is connected to the material tape 53. The elastic arm 45 is connected to a middle portion 42 of a bottom end of the fixing portion 41 and is inversely bent upwards. The first surface of the elastic arm 45 is formed with a projection 47, and the first surface without the projection 47 forms a plane. The first surface of the elastic arm 45 has a curved shape. The first surface of the elastic arm 45 is narrower than the first surface of the fixing portion 41. An angle smaller than 30 degrees is formed between the first surfaces of the elastic arm 45 and the fixing portion 41. In this embodiment, the first surface of the elastic arm 45 and the first surface of the fixing portion 41 are stacked together so that the angle is equal to zero degrees. A top end of the elastic arm 45 exceeds a top end and a lateral side of the fixing portion 41, and is formed with a contact 46 which may be moved up and down. The contact 46 is formed on the second surface of the metal plate. The connection sheets 48 to be connected and fixed to a solder ball 55 are connected to two sides of the bottom end of the fixing portion 41.

Figure 6:
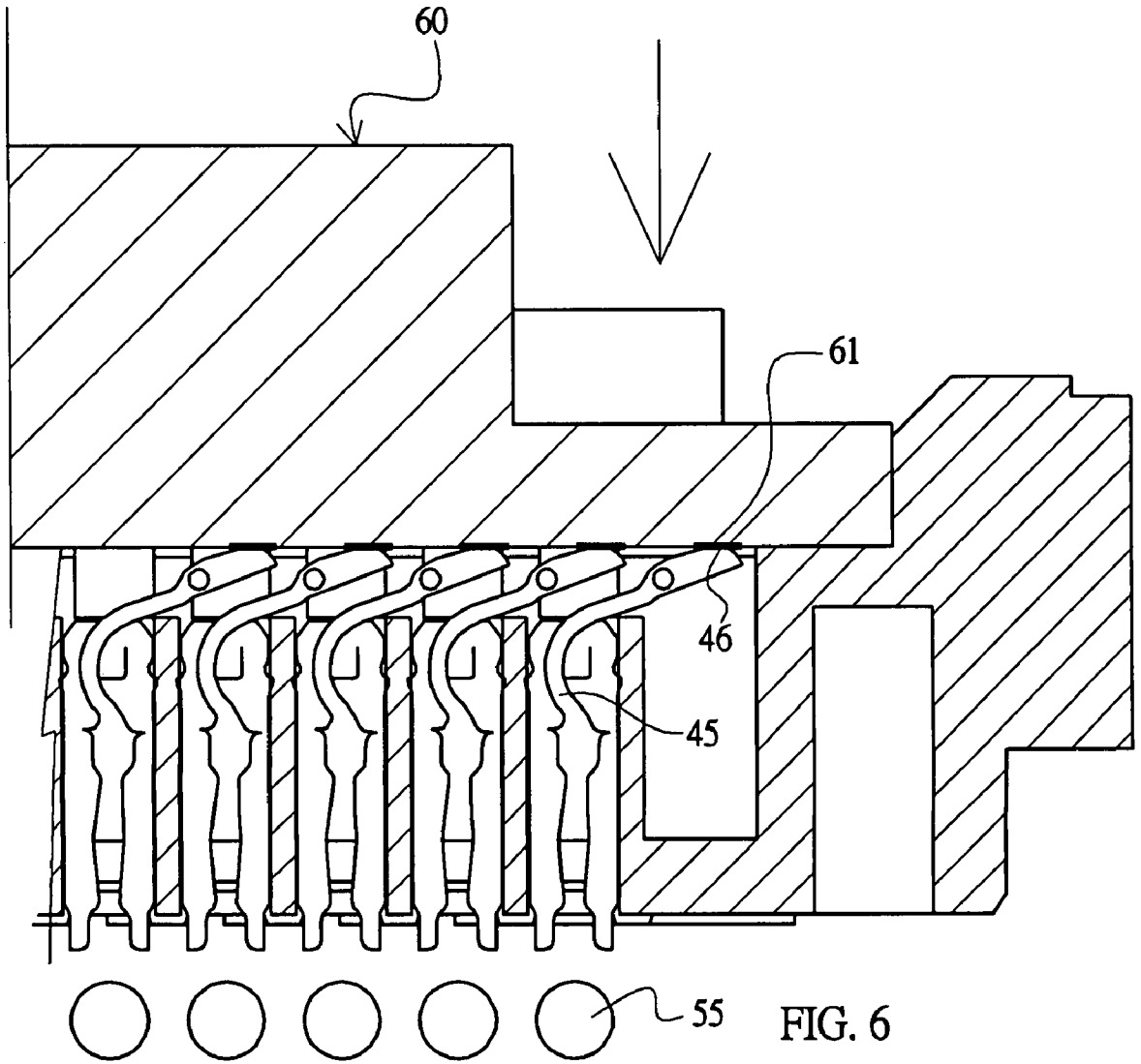
FIG. 6 is a schematic illustration showing a used state according to the first embodiment of the invention.

According to the above-mentioned structure, the elastic arm 45 of the terminal 40 is inversely bent upwards from the bottom end of the fixing portion 41, exceeds one side of the fixing portion and extends to the adjacent terminal slot 31. So, the elastic arm 45 may have the long arm of force and thus have the excellent elasticity. As shown in FIG. 6, when a chip 60 is placed to contact the terminals 40, the elastic arms 45 of the terminals are elastically moved so that the contacts 46 of the terminals can elastically contact the contacts 61 of the chip 60. The elastic arm 45 of the terminal extends slantingly from the lower location to the upper location and cannot touch the adjacent terminal 40 to cause the short circuited condition. Furthermore, the first surface of the elastic arm 45 longitudinally extends slantingly upwards to one side of the fixing portion 41. So, the length of the terminal slot 31 can be shortened so that the spatial arrangement may be optimized, and more terminal slots can be designed. In addition, the elastic arm 45 of the terminal is formed by cutting the metal plate but not bending the metal plate, so the size thereof can be easily controlled and the terminal can be easily manufactured.

The invention has the following advantages.

First, the elastic arm 45 of the terminal 40 is inversely bent upwards from the bottom end of the fixing portion 41 to exceed one side of the fixing portion and to extend to the adjacent terminal slot 31, so the elastic arm 45 has the excellent elasticity.

Second, the first surface of the elastic arm 45 of the terminal 40 longitudinally extends slantingly upwards to one side of the fixing portion 41. So, the length of the terminal slot 31 can be shortened so that the spatial arrangement may be optimized, and more terminal slots can be designed. In addition, the terminal may be easily manufactured.

Third, the elastic arm 45 of the terminal 40 is formed by cutting the metal plate but not bending the metal plate, so the size thereof can be easily controlled and the terminal can be easily manufactured.

Figure 7:
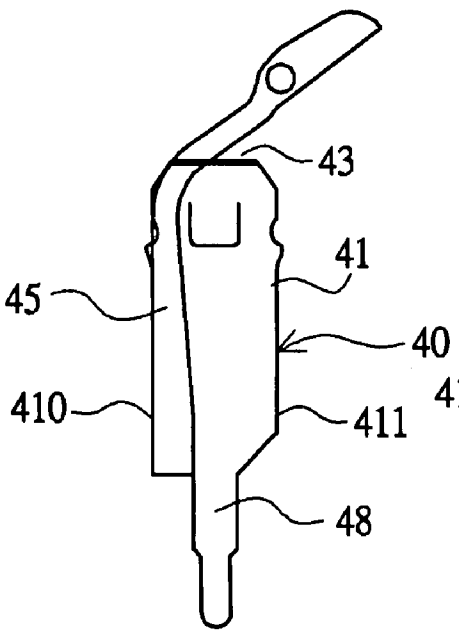
FIG. 7 is a plane view showing a terminal structure according to a second embodiment of the invention.

As shown in FIG. 7, the second embodiment of the invention is almost the same as the first embodiment except that the elastic arm 45 of the terminal 40 is inversely bent upwards from the left side of the bottom end of the fixing portion 41 and then extends rightwards to exceed the fixing portion 41, and the middle of the bottom end of the fixing portion 41 is connected to a connection sheet 48.

Figure 8:
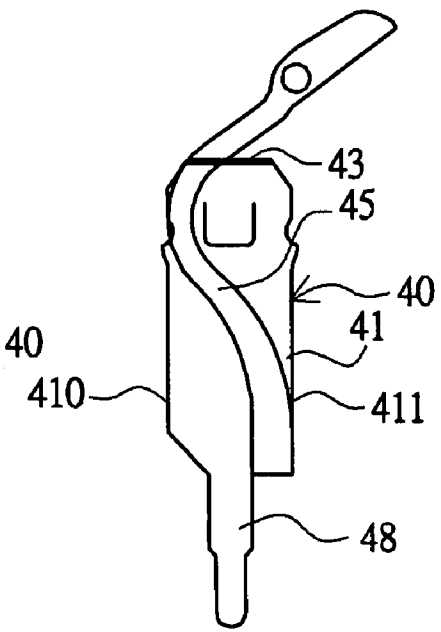
FIG. 8 is a plane view showing a terminal structure according to a third embodiment of the invention.

As shown in FIG. 8, the third embodiment of the invention is almost the same as the first embodiment except that the elastic arm 45 of the terminal 40 is inversely bent upwards from the right side of the bottom end of the fixing portion 41 and is curved rightwards and then leftwards to exceed the right side of the fixing portion, and the middle of the bottom end of the fixing portion 41 is connected to a connection sheet 48.

Figure 9:
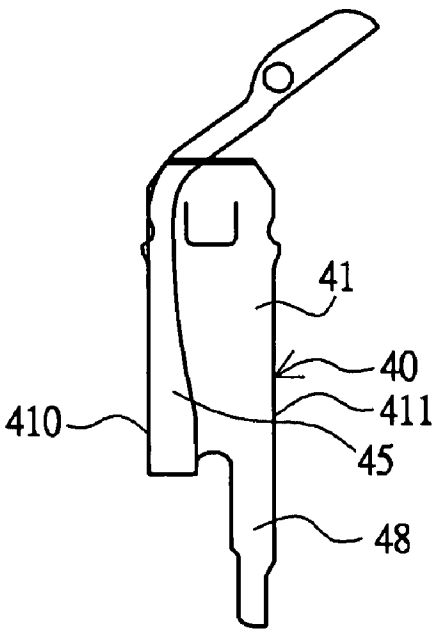
FIG. 9 is a plane view showing a terminal structure according to a fourth embodiment of the invention.

As shown in FIG. 9, the fourth embodiment of the invention is almost the same as the second embodiment except that the connection sheet 48 is connected to the right side of the bottom end of the fixing portion 41.

Figure 10:
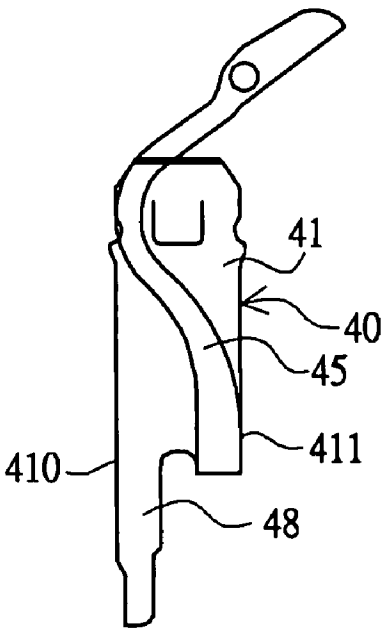
FIG. 10 is a plane view showing a terminal structure according to a fifth embodiment of the invention.

As shown in FIG. 10, the fifth embodiment of the invention is almost the same as the third embodiment except that the connection sheet 48 is connected to the left side of the bottom end of the fixing portion 41.

Figures 11, 12, 13, 14:
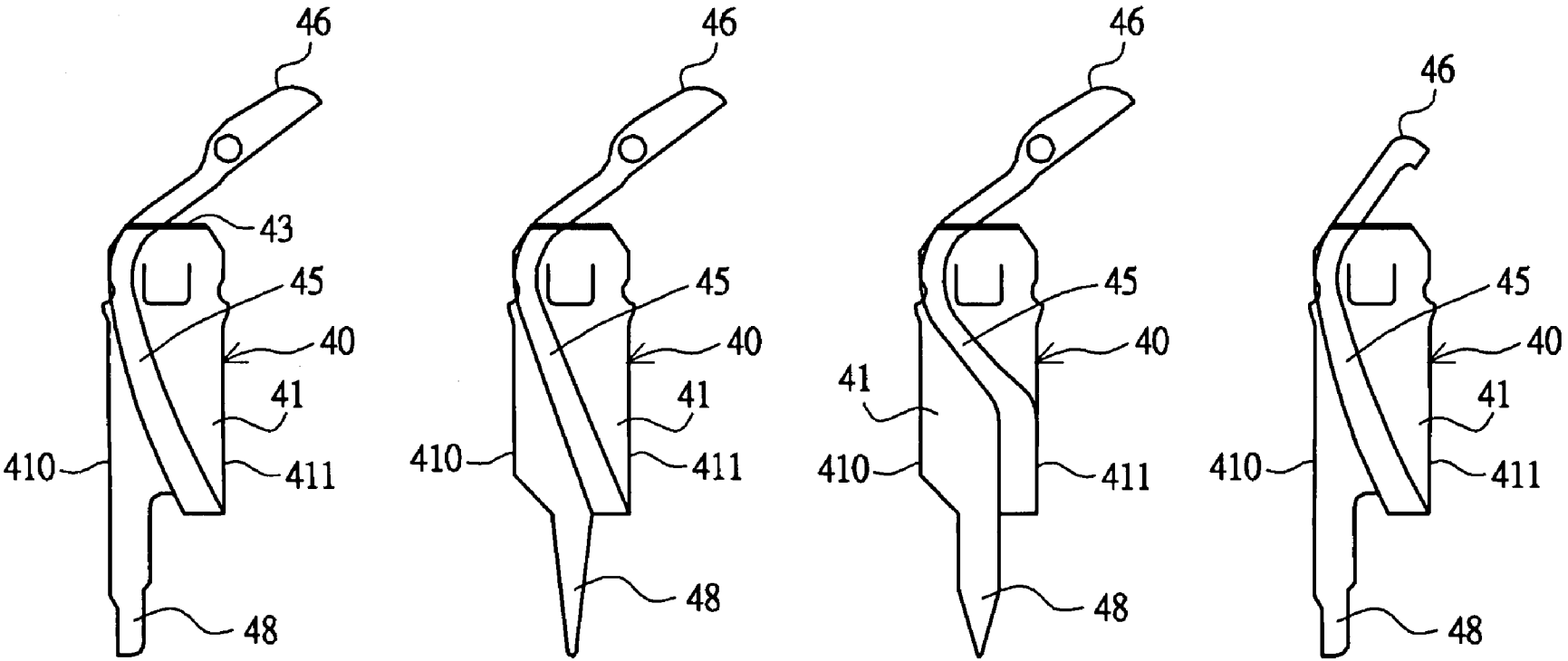
FIG. 11 is a plane view showing a terminal structure according to a sixth embodiment of the invention.
FIG. 12 is a plane view showing a terminal structure according to a seventh embodiment of the invention.
FIG. 13 is a plane view showing a terminal structure according to an eighth embodiment of the invention.
FIG. 14 is a plane view showing a terminal structure according to a ninth embodiment of the invention.

As shown in FIG. 11, the sixth embodiment of the invention is almost the same as the first embodiment except that the elastic arm 45 of the terminal 40 is inversely bent upwards from the right side of the bottom end of the fixing portion 41, and extends leftwards and then rightwards to exceed the fixing portion, and the left side of the bottom end of the fixing portion 41 is connected to a connection sheet 48.

As shown in FIG. 12, the seventh embodiment of the invention is almost the same as the sixth embodiment except that the bottom section of the elastic arm 45 of the terminal 40 has a sloped line, and the middle of the bottom end of the fixing portion 41 is connected to a connection sheet 48.

As shown in FIG. 13, the eighth embodiment of the invention is almost the same as the first embodiment except that the elastic arm 45 of the terminal 40 is inversely bent upwards from the right side of the bottom end of the fixing portion 41 and then extends upwards by a longitudinal length, and then curved leftwards and rightwards to exceed the right side of the fixing portion. The middle of the bottom end of the fixing portion 41 is connected to a connection sheet 48.

As shown in FIG. 14, the ninth embodiment of the invention is almost the same as the sixth embodiment except that the elastic arm 45 of the terminal 40 extends upwards but does not exceed the right side of the fixing portion 41.

Figures 15, 16, 17, 18:
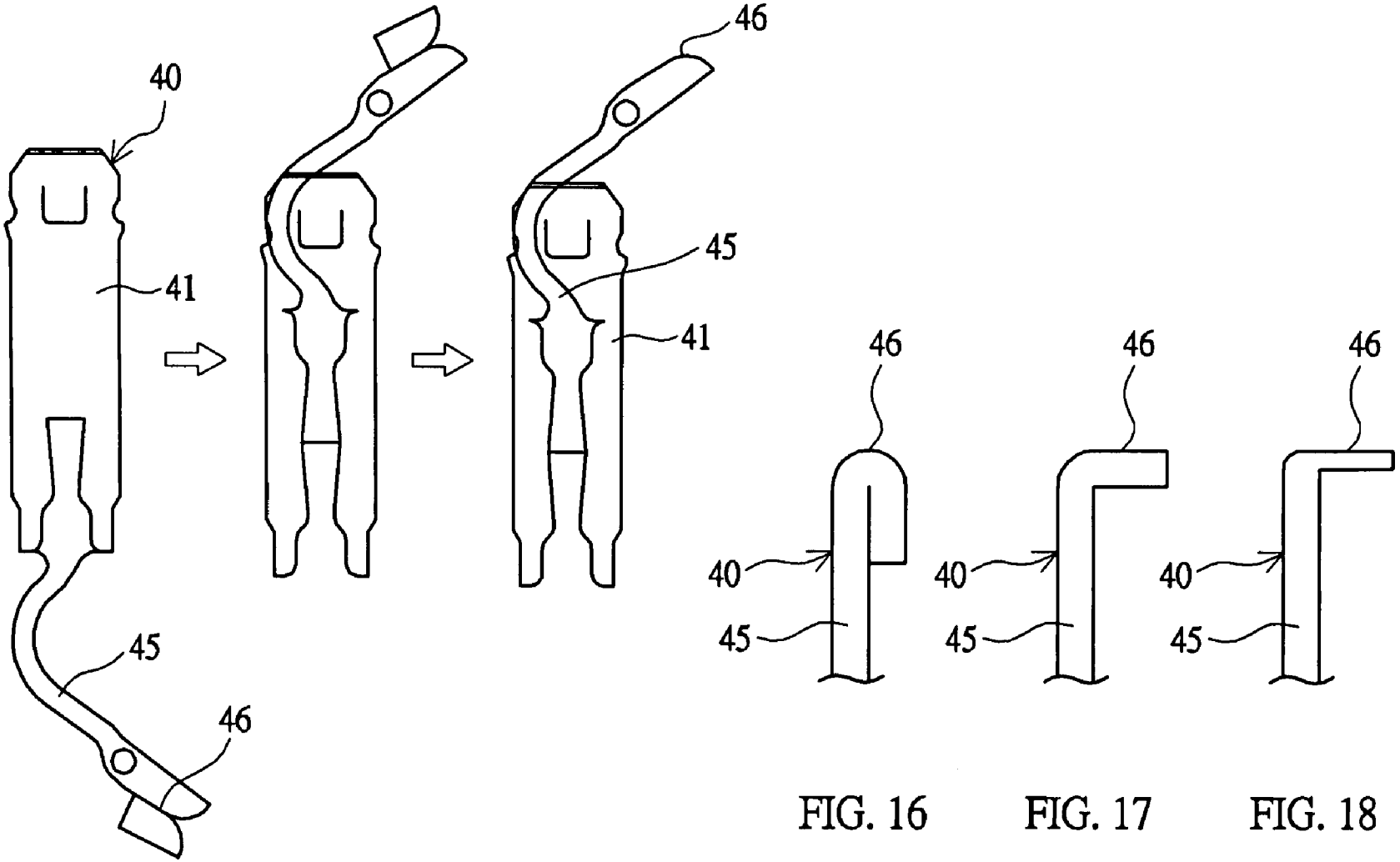
FIG. 15 is a plane view showing a terminal structure being manufactured according to a tenth embodiment of the invention.
FIG. 16 is a side view showing the terminal structure according to the tenth embodiment of the invention.
FIG. 17 is a side view showing a terminal structure according to an eleventh embodiment of the invention.
FIG. 18 is a side view showing a terminal structure according to a twelfth embodiment of the invention.

As shown in FIGS. 15 and 16, the tenth embodiment of the invention is almost the same as the first embodiment except that the contact 46 of the elastic arm 45 of the terminal 40 is formed by folding up the first surface, and the contact 46 has a circular arc surface perpendicular to the first surface of the elastic arm 45, but does not have the cut second surface.

As shown in FIG. 17, the eleventh embodiment of the invention is almost the same as the first embodiment except that the contact 46 of the elastic arm 45 of the terminal 40 is formed by bending the first surface.

As shown in FIG. 18, the twelfth embodiment of the invention is almost the same as the first embodiment except that the contact 46 of the elastic arm 45 of the terminal 40 is formed by extruding a material to form a horizontal flange having a reduced thickness.

Figure 20:
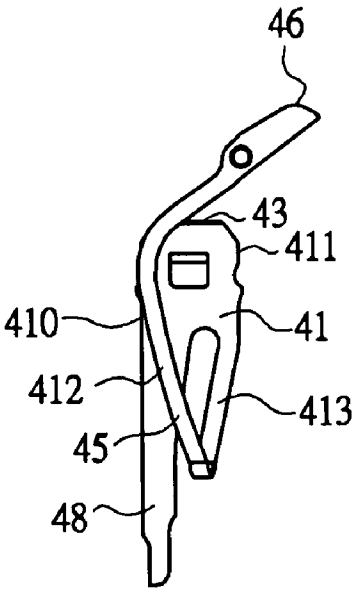
FIG. 20 is a plane view showing the terminal structure according to the thirteenth embodiment of the invention.
Figure 19:
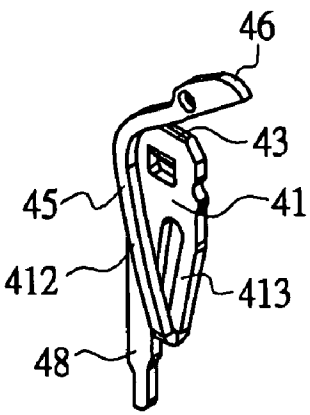
FIG. 19 is a pictorial view showing a terminal structure according to a thirteenth embodiment of the invention.

As shown in FIGS. 19 and 20, the thirteenth embodiment is similar to the sixth embodiment except that the elastic arm 45 of the terminal 40 includes a main elastic arm 412 and a sub-elastic arm 413. The sub-elastic arm 413 is connected to the bottom end of the second side 411 of the fixing portion 41. The sub-elastic arm 413 has the same surface as the first surface, and is bent downwards and slightly toward the first side 410. The main elastic arm 412 is bent inversely upwards so that the first surface thereof and the first surface of the fixing portion 41 are stacked together. The main elastic arm 412 is firstly bent toward the first side 410 of the fixing portion and then back toward the second side 411 of the fixing portion to exceed the top end 43 of the fixing portion and the second side 411. Thus, the main elastic arm 412, which is bent inversely, and the sub-elastic arm 413 substantially form a C shape. The main elastic arm 412 has a contact 46 near its distal end, and the contact 46 may be elastically moved up and down to contact the contact 61 of the chip 60 (see FIG. 6).

In this embodiment, the elastic arm 45 has the sub-elastic arm 413, which has the same surface as the fixing portion 41, so that the overall length of the elastic arm is lengthened and the elastic moving effect is enhanced. When the contact 46 is forced downwards, the sub-elastic arm 413 is elastically moved toward the first side 410 of the fixing portion, and the main elastic arm 412 is elastically moved toward the second side 411 so that the overall elastic effect becomes better.

Figure 21:
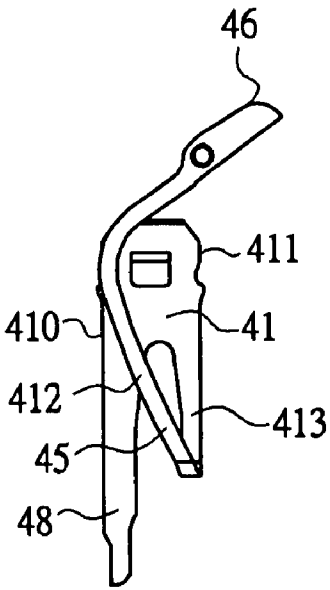
FIG. 21 is a plane view showing a terminal structure according to a fourteenth embodiment of the invention.

As shown in FIG. 21, the fourteenth embodiment of the invention is almost the same as the thirteenth embodiment except that the sub-elastic arm 413 directly extends downward and is not bent toward the first side 410 of the fixing portion.

Figure 22:
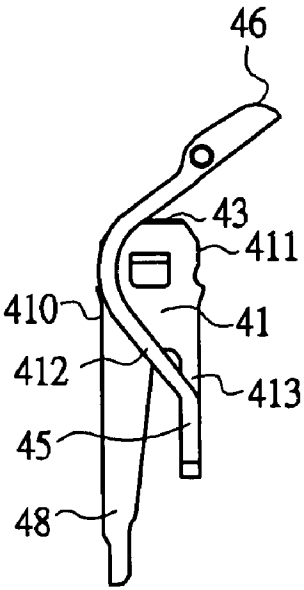
FIG. 22 is a plane view showing a terminal structure according to a fifteenth embodiment of the invention.

As shown in FIG. 22, the fifteenth embodiment is almost the same as the fourteenth embodiment except that the main elastic arm 412 is bent inversely upwards, extends by a longitudinal length, and is then bent toward the first side 410. Finally, the main elastic arm 412 is bent toward the second side 411 and exceeds the top end 43 of the fixing portion and the second side 411.

Figure 23:
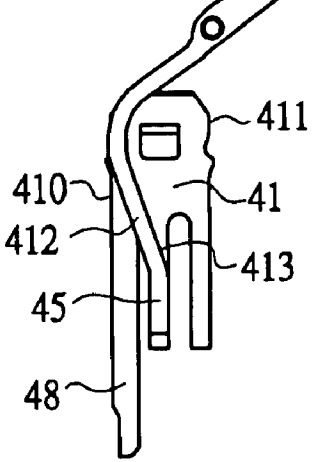
FIG. 23 is a plane view showing a terminal structure according to a sixteenth embodiment of the invention.

As shown in FIG. 23, the sixteenth embodiment is almost the same as the fifteenth embodiment except that the sub-elastic arm 413 is connected to the middle bottom end of the fixing portion 41 and has the same surface as the first surface.

Figure 24:
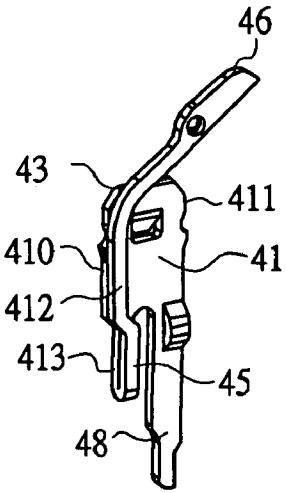
FIG. 24 is a plane view showing a terminal structure according to a seventeenth embodiment of the invention.

As shown in FIG. 24, the seventeenth embodiment is almost the same as the fifteenth embodiment except that the sub-elastic arm 413 of the elastic arm 45 is connected to the first side 410 of the fixing portion 41 and extends downwards. The main elastic arm 412 is bent inversely upwards and extends to the first side 410 of the fixing portion and is then bent toward the second side 411 to exceed the top end 43 of the fixing portion and the second side 411. The contact 46, which may be elastically moved up and down, is formed near a distal end of the main elastic arm 412. The sub-elastic arm 413 is separated from the first side 411 by a gap, the sub-elastic arm still can be elastically moved toward the first side 410 of the fixing portion when the contact 46 is forced downwards.

Figure 25:
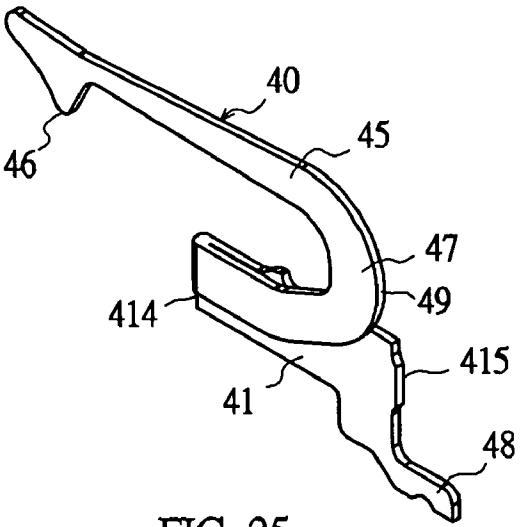
FIG. 25 is a pictorial view showing a terminal structure according to an eighteenth embodiment of the invention.

As shown in FIG. 25, the eighteenth embodiment is similar to the first embodiment. Each terminal 40 has a first surface 47, which extends in a lengthwise direction and a widthwise direction, and a second surface 49, which extends in a thickwise direction and the lengthwise direction. Each terminal 40 includes a fixing portion 41, an elastic arm 45 and a connection sheet 48. The fixing portion 41 has a first surface longitudinally fixed in the terminal slot of the plastic base, a front end 414 and a rear end 415. The elastic arm 45 is formed by pressing the first surface to form a curved shape extending in a direction of the second surface. The elastic arm 45 is connected to the front end 414 of the fixing portion 41 and is bent inversely upwards to extend along the direction of the second surface 49. The elastic arm 45 firstly extends toward the rear end 415 of the fixing portion 41 and is then bent upwards to extend toward the front end 414 of the fixing portion 41 to exceed the front end 414 of the fixing portion 41. A contact 46 convex downward is formed near a distal end of the elastic arm 45. The contact 46 is formed on the second surface. The connection sheet 48 is connected to the rear end of the fixing portion 41 and extends in a horizontal direction.

Figure 26:
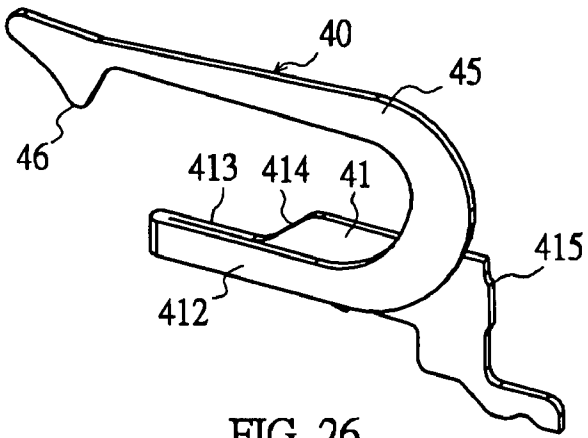
FIG. 26 is a pictorial view showing a terminal structure according to a nineteenth embodiment of the invention.

As shown in FIG. 26, the nineteenth embodiment is almost the same as the seventeenth embodiment except that the elastic arm 45 of the terminal 40 includes a main elastic arm 412 and a sub-elastic arm 413. The sub-elastic arm 413 is connected to the front end 414 of the fixing portion 41, has the same surface as the first surface, and extends forwards. The main elastic arm 412 is inversely bent and extends to make its first surface be stacked with the first surface of the fixing portion 41.

Figure 27:
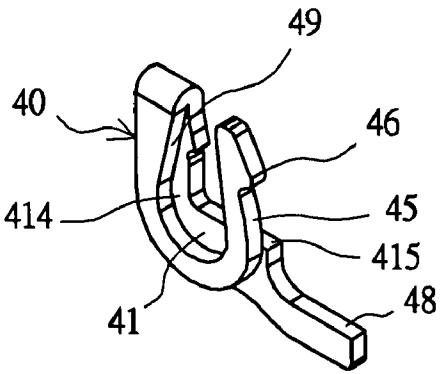
FIG. 27 is a pictorial view showing a terminal structure according to a twentieth embodiment of the invention.

As shown in FIG. 27, the twentieth embodiment is almost the same as the seventeenth embodiment except that the fixing portion 41 of the terminal 40 has an L shape. The elastic arm 45 is connected to the front end 414 of the fixing portion 41 and is bent inversely to extend along the direction of the second surface. The elastic arm 45 firstly extends downwards, and is then bent to extend backwards and upwards. A laterally projecting contact 46 is formed at a distal end thereof, and the contact 46 is formed on the second surface.

Figure 28:
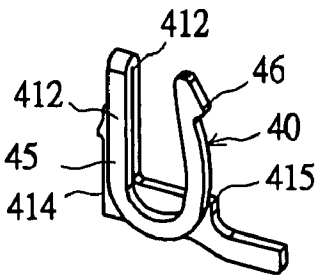
FIG. 28 is a pictorial view showing a terminal structure according to a 21$^{st}$ embodiment of the invention.

As shown in FIG. 28, the 21st embodiment is almost the same as the nineteenth embodiment except that the elastic arm 45 of the terminal 40 includes a main elastic arm 412 and a sub-elastic arm 413. The sub-elastic arm 413 is connected to the front end 414 of the fixing portion 41 and has the same surface as the first surface. The elastic arm 45 extends upwards. The main elastic arm 412 is inversely bent and extends to make its first surface be stacked with the first surface of the fixing portion 41.

While the invention has been described by way of examples and in terms of preferred embodiments, it is to be understood that the invention is not limited thereto. To the contrary, it is intended to cover various modifications. Therefore, the scope of the appended claims should be accorded the broadest interpretation so as to encompass all such modifications.

What is claimed is:

1. A terminal structure of an electrical connector, wherein the terminal structure is to be assembled in a terminal slot of a plastic base, and is integrally formed by pressing a metal plate having a first surface, which extends in a lengthwise direction and a widthwise direction, and a second surface, which extends in a thickwise direction and the lengthwise direction and is connected to the first surface, the terminal structure comprising:

a fixing portion, wherein the first surface of the fixing portion is longitudinally fixed in the terminal slot of the plastic base and is wider so that the first surface of the fixing portion is fixed in the terminal slot of the plastic base; and an elastic arm, which is connected to a bottom end of the fixing portion, wherein over 70% of the first surface of the elastic arm are disposed on the same plane and the first surface of the elastic arm has a curved shape, the first surface of the elastic arm is narrower than the first surface of the fixing portion, an angle smaller than 30 degrees is formed between the first surfaces of the elastic arm and the fixing portion, and a top end of the elastic arm exceeds a top end of the fixing portion, and is formed with a contact which may be elastically moved to contact a contact of a chip.

2. The terminal structure according to claim 1, wherein the elastic arm has a main elastic arm and a sub-elastic arm, the sub-elastic arm is connected to the fixing portion and has the same surface as the first surface, the main elastic arm is inversely bent and extends so that the first surface of the main elastic arm and the first surface of the fixing portion are stacked together, and the contact is formed near a distal end of the main elastic arm.

3. The terminal structure according to claim 1, wherein the bottom end of the fixing portion is formed with a connection portion to be combined with a solder ball.

4. The terminal structure according to claim 1, wherein the elastic arm is connected to the bottom end of the fixing portion, the elastic arm is bent toward one side of the fixing portion and gradually upwards and extends over the top end of the fixing portion, the elastic arm may be elastically moved up and down, and the elastic arm has the contact, which may be elastically moved up and down to contact the contact of the chip.

5. The terminal structure according to claim 2, wherein the elastic arm is connected to a bottom end of the fixing portion, the elastic arm is bent toward one side of the fixing portion and gradually upwards and extends over the top end of the fixing portion, the elastic arm may be elastically moved up and down, and the elastic arm has the contact, which may be elastically moved up and down to contact the contact of the chip.

6. The terminal structure according to claim 4, wherein the contact of the elastic arm exceeds one lateral side of the fixing portion.

7. The terminal structure according to claim 1, wherein the elastic arm has a U shape and may be elastically moved laterally, and the elastic arm is formed with the contact, which may be moved left and right to contact the contact of the chip.

8. The terminal structure according to claim 2, wherein the main elastic arm has a U shape and may be elastically moved laterally, and the elastic arm is formed with the contact, which may be elastically moved left and right to contact the contact of the chip.

9. The terminal structure according to claim 1, wherein the elastic arm has a C shape and may be elastically moved up and down, and the elastic arm is formed with the contact, which may be elastically moved up and down to contact the contact of the chip.

10. The terminal structure according to claim 2, wherein the main elastic arm of the elastic arm has a C shape and may be elastically moved up and down, and the elastic arm is formed with the contact, which may be elastically moved up and down to contact the contact of the chip.

11. The terminal structure according to claim 3, wherein the connection portion is a horizontal pin.

12. The terminal structure according to claim 1, wherein the contact of the elastic arm is formed on the second surface.

13. The terminal structure according to claim 1, wherein the contact of the elastic arm is formed by folding up the first surface, and the contact has a circular arc surface perpendicular to the first surface of the elastic arm.

14. The terminal structure according to claim 1, wherein the contact of the elastic arm is formed by bending the first surface.

15. The terminal structure according to claim 1, wherein the contact of the elastic arm is formed by extruding a material to form a horizontal flange having a reduced thickness.

16. The terminal structure according to claim 1, wherein the first surface of the elastic arm and the first surface of the fixing portion are stacked together.

17. The terminal structure according to claim 4, wherein the fixing portion has a first side and a second side, the elastic arm is connected to the first side of the fixing portion and is bent inversely upwards and extends toward the second side of the fixing portion.

18. The terminal structure according to claim 5, wherein the fixing portion has a first side and a second side, the sub-elastic arm of the elastic arm is connected to the first side of the fixing portion and extends downwards, and the main elastic arm is bent inversely upwards toward the first side of the fixing portion and then extends to the second side.

19. The terminal structure according to claim 4, wherein fixing portion has a first side and a second side, the elastic arm is connected to the second side of the fixing portion, the elastic arm is bent inversely upwards to form an arc shape, and the elastic arm is firstly bent toward the first side of the fixing portion and then back to the second side of the fixing portion.

20. The terminal structure according to claim 5, wherein the fixing portion has a first side and a second side, the sub-elastic arm of the elastic arm extends to the second side of the fixing portion and is bent downwards and slightly toward the first side, the main elastic arm is bent upward and toward the first side of the fixing portion and then back to the second side of the fixing portion so that the bent main elastic arm and the sub-elastic arm substantially form a C shape.

* * * * *